US005890862A

United States Patent [19]

Spiel et al.

[11] Patent Number: 5,890,862

[45] Date of Patent: Apr. 6, 1999

[54] SEMI-AUTOMATIC PLASTIC SPIRAL BINDING MACHINE

[76] Inventors: Norton Spiel, 181-40 Midland Pky., Jamaica, N.Y. 11432; Robert Dorishook, 1234 Wisconsin Ave., Cape May, N.J. 08204

[21] Appl. No.: 843,754

[22] Filed: Apr. 21, 1997

[51] Int. Cl.[6] ..... B42B 9/00; B42B 5/10; B42B 5/12

[52] U.S. Cl. ..... 412/40; 412/38; 412/39; 412/33; 412/9

[58] Field of Search ..... 412/9, 11, 12, 412/13, 14, 33, 38, 39, 40, 7; 140/92.3, 92.4, 92.7, 71 R, 71 C

[56] References Cited

U.S. PATENT DOCUMENTS

| | | | |
|---|---|---|---|
| Re. 30,491 | 1/1981 | Gomez | 11/1 A |
| D. 365,580 | 12/1995 | Stiles | D15/128 |
| 2,638,609 | 5/1953 | Penner | 11/1 |
| 3,592,242 | 7/1971 | Sickinger | 140/92.94 |
| 3,760,444 | 9/1973 | McNichol | 412/34 |
| 3,761,983 | 10/1973 | Staats | 412/40 |
| 3,793,660 | 2/1974 | Sims | 412/40 |
| 3,826,290 | 7/1974 | Pfaffle | 140/92.7 |
| 3,839,759 | 10/1974 | Staats et al. | 412/7 |
| 3,854,158 | 12/1974 | Pigna et al. | 412/39 |
| 3,863,596 | 2/1975 | Anderson | 118/667 |
| 3,866,254 | 2/1975 | Gronda | 412/40 |
| 3,922,109 | 11/1975 | Hagen | 416/213 |
| 3,924,664 | 12/1975 | Pfaffle | 140/92.7 |
| 3,967,336 | 7/1976 | Cutter | 412/13 |
| 4,008,501 | 2/1977 | Cutter | 412/13 |
| 4,100,640 | 7/1978 | Takimoto | 412/43 |
| 4,129,156 | 12/1978 | Pfaffle | 140/92.4 |
| 4,137,289 | 1/1979 | Staats | 264/128 |
| 4,143,686 | 3/1979 | Sickinger | 140/92.93 |
| 4,157,821 | 6/1979 | Fabrig | 270/53 |
| 4,161,196 | 7/1979 | Fabrig | 140/92.4 |
| 4,165,766 | 8/1979 | Fabrig | 140/92.7 |
| 4,178,972 | 12/1979 | Pfaffle | 140/105 |
| 4,185,668 | 1/1980 | Harbert | 140/92.4 |
| 4,232,858 | 11/1980 | Fabrig | 270/53 |
| 4,237,568 | 12/1980 | Kunzmann | 11/1 R |
| 4,249,278 | 2/1981 | Pfaffle | 11/1 A |
| 4,327,780 | 5/1982 | Lehmann | 140/92.7 |
| 4,367,815 | 1/1983 | Fabrig | 198/374 |
| 4,369,015 | 1/1983 | Fabrig | 414/31 |
| 4,373,558 | 2/1983 | Dawson | 140/71 R |
| 4,378,822 | 4/1983 | Morris | 140/92.3 |
| 4,425,773 | 1/1984 | Fabrig | 72/142 |
| 4,426,871 | 1/1984 | Fabrig | 72/141 |
| 4,501,304 | 2/1985 | Lehmann | 140/103 |
| 4,545,603 | 10/1985 | Henes | 281/21 A |
| 4,729,708 | 3/1988 | Fabrig | 412/1 |
| 4,811,973 | 3/1989 | Kumar-Misir | 281/21 A |
| 4,833,980 | 5/1989 | Bringhurst | 101/93.04 |
| 4,886,259 | 12/1989 | Ishikawa | 270/53 |
| 5,036,690 | 8/1991 | McGowen | 72/49 |
| 5,407,232 | 4/1995 | DesJarlais | 281/16 |
| 5,417,508 | 5/1995 | Friedman | 402/19 |
| 5,497,811 | 3/1996 | Pigna | 140/71 R |

OTHER PUBLICATIONS

"Semi–Automatic Coil Binder" of Sickinger Company, Auburn Hills, MI, 1996 brochure for models PS517 and PS525.

"SB300 Spiral Binding Machine" of Spiral Binding Company, Totowa, NJ, undated brochure.

*Primary Examiner*—Frances Han

*Attorney, Agent, or Firm*—Alfred M. Walker

[57] ABSTRACT

A binding machine for spirally binding a sheaf of papers into a book uses an adjustable speed drive to rotate a flexible plastic spiral element into respective holes in the book. The book has a plurality of holes in a row adjacent one edge of the book to receive the leading edge of the spiral bonding elements. A cylindrically shaped mandrel is spaced apart from a glidable block. The plastic pre-formed spiral binding element is fed onto the mandrel from the distal end thereof, with the leading edge of the binding element facing and spaced apart from the book. A spring is mounted on the slidable block for engaging and adjustably press the spiral binding element on the mandrel so that the upper portion of the binding element is spaced from the top of the mandrel.

6 Claims, 7 Drawing Sheets

115 VAC
100
101
14
31
7
102
103
NO
NC
106
104
6
32
98
35
109
107
108
110
111
37
33
34
96
97

SEMI-AUTOMATIC PLASTIC SPIRAL BINDING MACHINE

FIELD OF THE INVENTION

The invention relates to a semi-automatic plastic spiral binding machine which inserts the plastic spiral and cuts and inwardly bends the coil ends.

BACKGROUND OF THE INVENTION

While most of the prior art in the field of spiral binding apparatus relates to the use of metallic wire spirals, two patents specifically relate to the use of plastic spirals. The patent of Penner (U.S. Pat. No. 2,638,609) describes a machine for binding books with special features for aligning the perforations of a sheaf of papers to be bound and to confine the travel of the plastic spiral binding material. The patent of Pfaffle (U.S. Pat. No. 4,249,278) describes a machine for spiral binding which feeds plastic thread from a bulk spool, softens the thread, winds it on a mandrel to form a spiral, cools it to harden and then feeds the rigid spiral into a perforated sheet group.

U.S. Pat. No. 4,378,822 of Morris describes a spiral binding machine with a drive component. However, the mandrel of Morris '822 is fixed, not laterally adjustable as in the present invention, and the mandrel of Morris '822 has a closed end, which requires pre-feeding of the spiral thereon.

OBJECTS OF THE INVENTION

It is an object of this invention to overcome the complexity of prior art machines that are designed to handle plastic spirals for binding.

It is another object of this invention to be able to handle a wide variety of plastic spiral sizes with minimal custom tooling features to handle the different sizes.

It is another object of this invention to provide a semi-automatic machine of low cost and reliable operation.

SUMMARY OF THE INVENTION

In keeping with the objects of the present invention and others which may become apparent, the basic operational concept of the present invention is to use an adjustable speed drive to rotate the spiral at optimum speed for the diameter of a particular spiral as well as the thickness of the book being bound. This, along with a smooth mandrel with a spiral stabilizing spring, controls the proper feeding of the spiral without the necessity for expensive machined parts to confine the spiral to prevent its distortion.

The binding machine of the present invention spirally binds a sheaf of papers into a book. It clamps together the sheaf of papers making up the book, which book has a plurality of holes in a row adjacent to one edge of the book, to receive the leading edge of the spiral binding element. The machine includes a stationary base which is from one end of the book, and a block slidably mounted on the base, which has an arm extending outwardly.

The arm supports at its distal end thereof a cylindrically shaped mandrel, which is spaced from the slidable block and the bottom edge of the mandrel horizontally in a line corresponding with the row of holes in the book. The arm is attached at its distal end to the mandrel at the proximate end of the mandrel, which faces the row of holes and is spaced apart from the book. The arm is attached to the block at the proximate end, to adjust the distance between the mandrel and the block.

A feeding mechanism feeds a plastic, pre-formed, spiral binding element onto the mandrel, from the distal end thereof, which spiral binding element terminates at the proximate end of the mandrel. The leading edge of the binding element faces, and is spaced apart from, the book. The internal diameter of the spiral binding element is slightly in excess in size of the outer diameter of the mandrel.

A spring is mounted on the slidable block to engage and to adjustably bias the spiral binding element on the mandrel upwardly, against the mandrel, so that the upper portion of the binding element is spaced apart from the top of the mandrel.

A wheel, having an outer frictional surface, engages a top outer surface of the spiral binding element and a motor drives the wheel, to feed the spiral binding element into the row of holes in the book, for binding the book.

An adjusting mechanism adjusts the position of the block on the base, positioning the mandrel, to obtain proper alignment of the leading edge of the spiral binding element with the row of holes of the book.

The binding machine also optionally has a cutter for cutting. The spiral binding element is wound on the book at both ends of the book, and bends both ends of the binding element on the book.

Preferably, the binding machine includes a sensor, such as an optical sensor, for signaling that the leading edge of the spiral binding element has been reached.

A positioning mechanism, such as a pneumatically driven mechanism, positions a rotatable wheel for contact with the spiral binding element. It includes a hydraulic shock absorber for mediating the speed of engagement of the wheel with the spiral binding element.

Furthermore, optionally the cutter includes a pair of separated cutting members which are spaced apart from each other, and a rotatable arm for engaging the two cutting members and for actuating the cutting and bending action when rotated in one direction. A further member moves the rotatable arm in a second direction.

A control panel is provided for sequencing the steps of binding the book and indicating visually when the cutting and bending of ends is completed, so that the binding action can be repeated for the next subsequent book to be spirally bound.

BRIEF DESCRIPTION OF THE DRAWINGS

FIG. 2A is a side view of an alternate preferred embodiment of the binding machine;

FIG. 2B is a close up perspective view of the coil stop portion of the binding machine as in FIG. 2A;

FIG. 2C is a close up perspective view of an L-shaped book stop to regulate pitch angle of the book spiral.

FIG. 4A is a front elevational view of a preferred embodiment for the mandrel holding spring member;

FIG. 5 is a front view close-up of cutter;

DETAILED DESCRIPTION OF THE DRAWINGS

Figure 1:
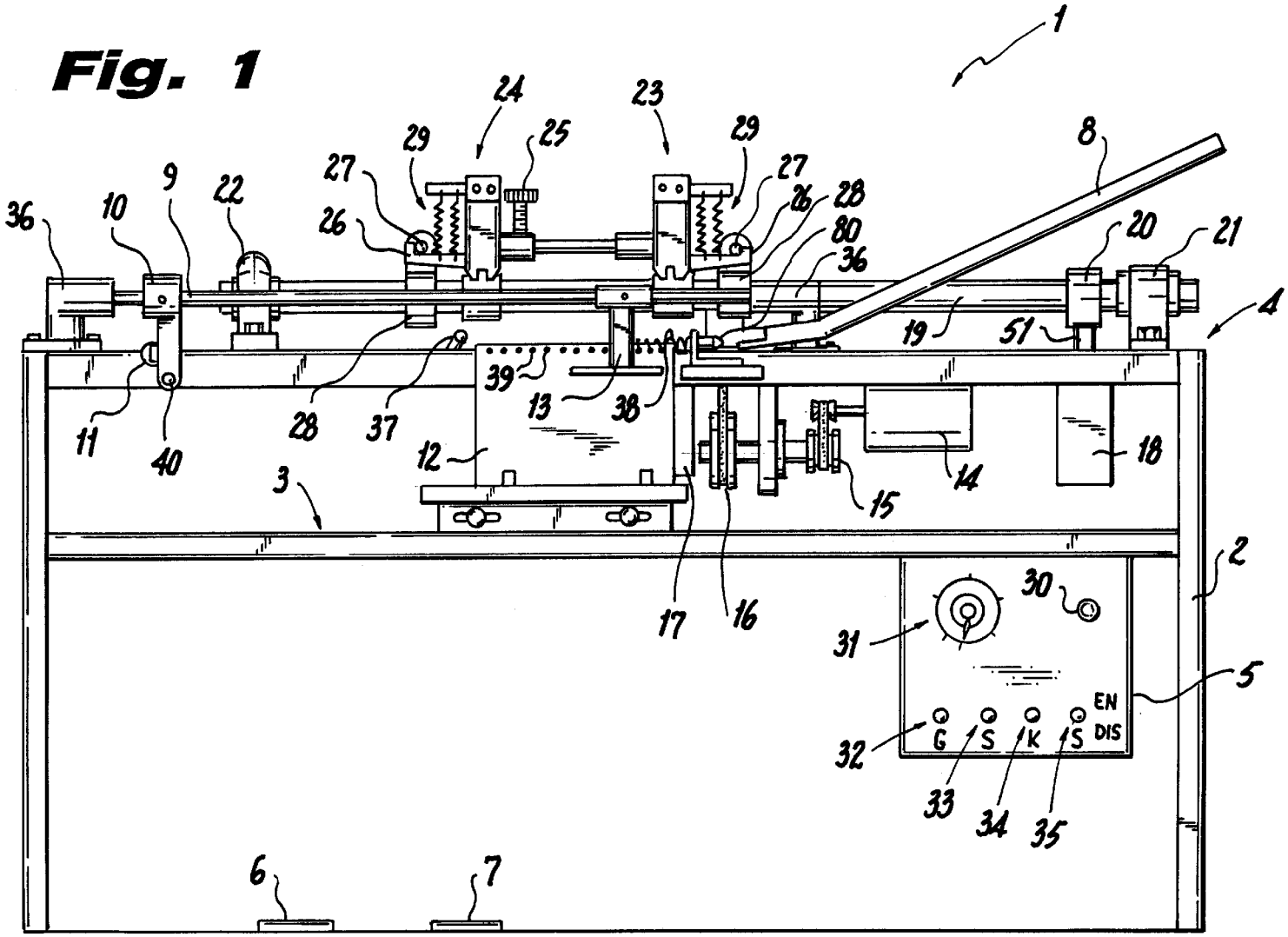
FIG. 1 is a front view of the binding machine of the present invention.

FIG. 1 shows a front view of the semi-automatic plastic spiral binding machine 1. A frame 2 supports a lower shelf 3 and a top shelf 4 which is a mounting platform for most of the apparatus. A control panel 5 shows a spinner speed control 31, a main on/off switch 30 and four other switches which have enable/disable positions. These switches are used to isolate several machine subsystems during diagnostic testing or preventative maintenance. They are the gate switch 32, the spinner engage switch 33, the knife switch 34 and the sensor switch 35. Except for the spiral spinner which is driven by an electric motor 14, all of the other moving elements of the machine 1 are pneumatically driven. This is a cost-effective and reliable design feature.

Figure 2:
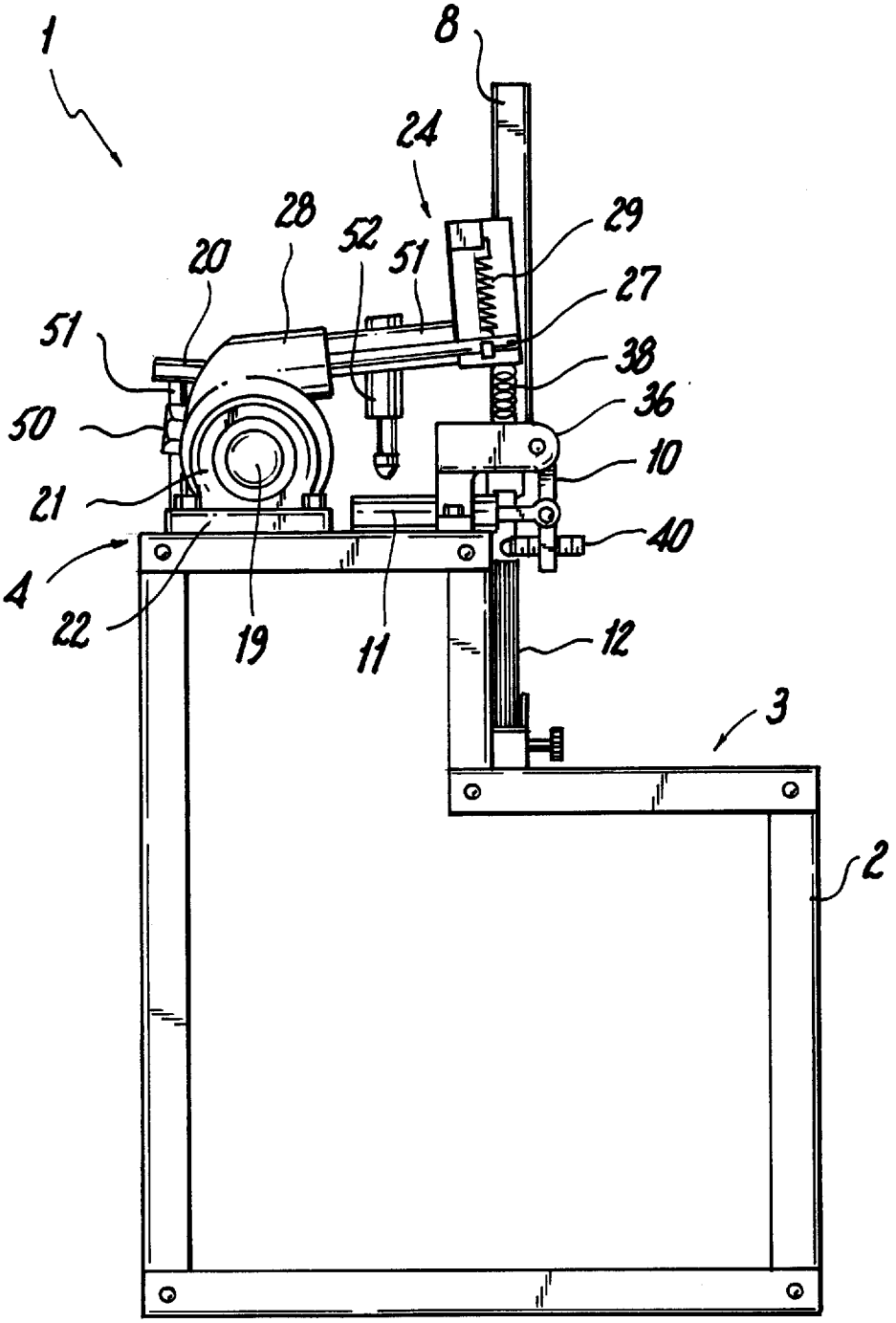
FIG. 2 is a side view of one embodiment for the binding machine.

Some of the machine elements may be more visible in the side view of FIG. 2. A main shaft 19 is carried in bearing blocks 22 and 21; it rotates only a about 30 degrees in operation and is driven by pneumatic cylinder 18 through piston rod 51 acting on offset arm 20 which is fastened to main shaft 19. Shaft 19 is used to actuate both cutters 23 and 24 through drive bars 27 attached to shaft collars 26. Each of the cutters 23 and 24 pivots on an arm 51 which rotates freely on shaft 19. This arm is spring biased through adjustable stop 52 to be at its uppermost position until urged downward by the action of bar 27.

Dual springs 29 resist the motion of bar 27 thereby moving the entire cutter 23 or 24 downward into engagement with the spiral 38 end to be cut; this coincides with the stop adjustment of 52. At this point, further downward movement of the end of bar 27 moves arm 26 which actuates the cutter/bender element (not shown) within cutters 23 and 24. A sensor switch 108 (not shown in these views) detects that the cutting action has been accomplished. Cutter 23 is fixed laterally to coincide with the rightmost edge of book 12; cutter 24 has a lateral adjustment 25 which adjusts it to the left edge of book 12.

A book 12 to be bound is shown clamped by clamp element 13 attached to clamp shaft 9 which is retained in bearing blocks 36. The clamping action is supplied by pneumatic cylinder 11 acting on arm 10. Adjustable stop screw 40 adjusts the clamping to the thickness of book 12 and also actuates a "gate down" sensor switch 105 (not shown in these views). The book 12 is supported by adjustable book holder 17.

Book 12 has holes 39 which will accept plastic spiral wire 38 as it emerges from the mandrel 80 which is barely visible in FIG. 1 at the left end of spiral chute 8. The spiral wire 38 is spun by a dc gear motor 14 which drives a jackshaft through a timing belt and pulley arrangement 15. The final spinner drive is via belt 16. An optical detector 37 detects the end of the spiral wire 38 as it emerges from the left edge of book 12.

In the preferred embodiment shown in FIGS. 2A and 2B, half cylindrical stop member 201 extends longitudinally adjacent to spiral wire 38 to restrict lateral movement thereof. Moreover, in the preferred embodiment of FIG. 2C, L-shaped angled book stop 202 maintains pitch angle of the perforation holes 39 which accept spiral wire 38.

Figure 3:
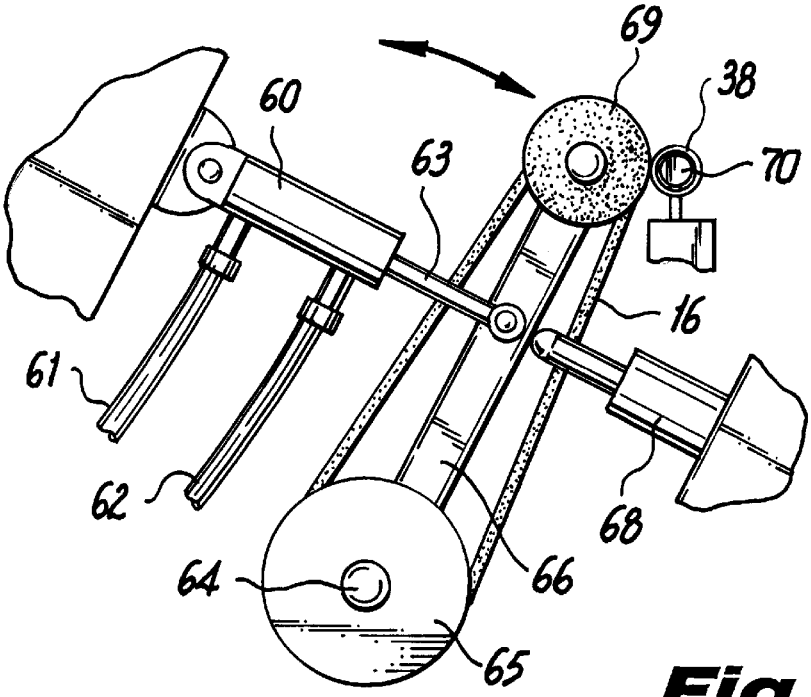
FIG. 3 is an end view of spiral drive mechanism.

FIG. 3 is a simplified end view of the engagement and drive system of the spiral spinner.

Figure 4:
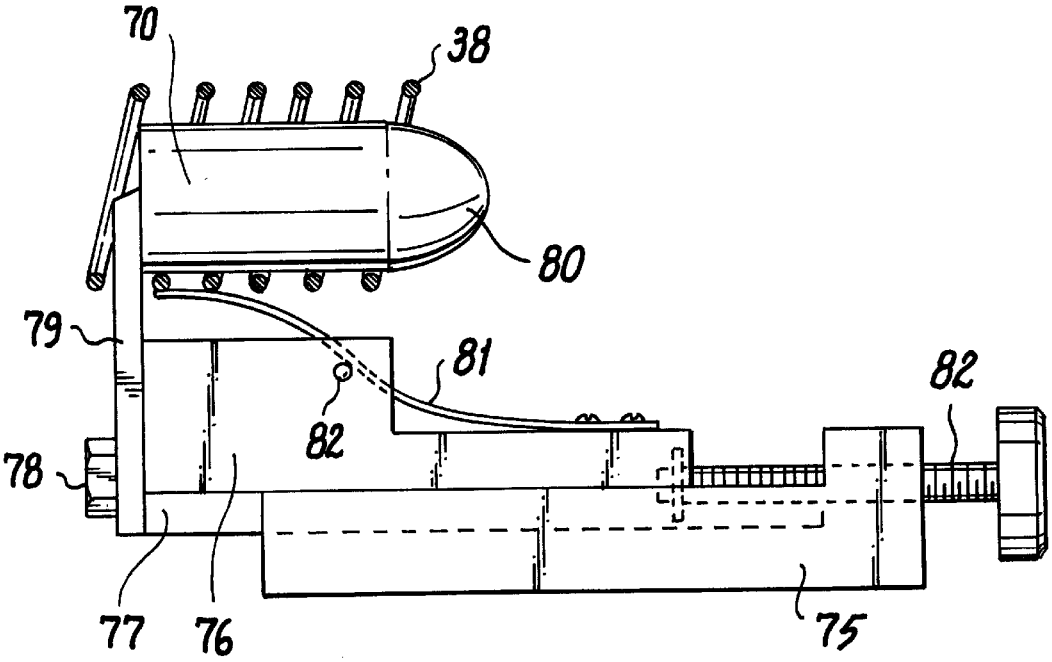
FIG. 4 is a front view close-up of the mandrel.

FIG. 4 is a front view of the mandrel 70 fixture with the spiral shown in crossection for clarity. The mandrel 70 has a bullet shaped nose 80 over with spiral wire 38 is fed from chute 8. An upright 79 which fits between the spiral wire 38 coils attaches mandrel 70 to block 76 by bolt 78. Block 76 is slidably attached to base 75 through dovetail slide 77 and a vernier adjustable in a lateral direction via vernier screw 82. A stabilizing leaf spring 81 gently presses the coils of spiral wire 38 against mandrel 70. The force can be adjusted by laterally sliding spring 81 over pin 82 and then tightening the retaining screws.

FIG. 3 shows an end view of spiral wire 38 around mandrel 70 with a wheel, such as fabric covered foam rubber wheel 69, pressing against it to rotate it. Alternatively, a wheel with a soft rubber tire can be used. The wheel 69 is urged against the spiral wire 38 or withdrawn from it by pneumatic cylinder 60 with extend port 61 and retract port 62. The speed of engagement is mediated by hydraulic shock absorber or snubber 68 which is always in contact with arm 66 which pivots concentrically on shaft 64. Pulley 65 and belt 16 drive wheel 69 by an upper pulley (not shown).

In the preferred embodiment shown in FIG. 4A, coil stop member 181 includes projections 182, 183 to engage between adjacent coils of spiral wire 38, to hold spiral wire 38 in place. Upward tension against coil stop member 181 is provided by coil spring 184.

Figure 5A:
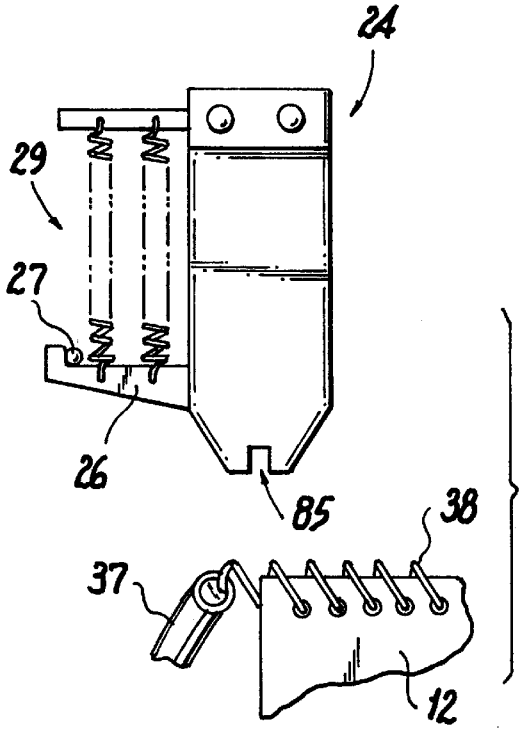
FIG. 5A is a view in raised position.
Figure 5B:
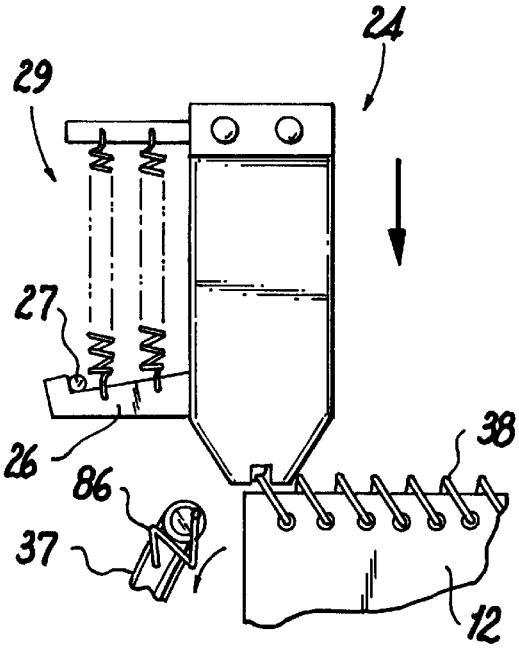
FIG. 5B is a view in cutting position.

FIG. 5 shows the geometric relation of cutter 24 in its raised position at "A" and in its cutting position at "B" with cut spiral end 86 falling away. The position of optical sensor 37 relates to the emerging spiral wire 38 and the left edge of book 12. Being mounted via an adjustable armored cable it can easily accommodate a variety of book 12 widths.

Figure 6:
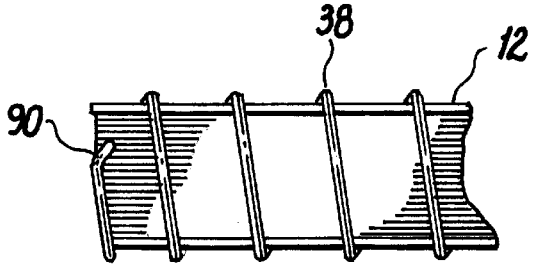
FIG. 6 is a top view of cut and bent spiral end.

FIG. 6 is a top view detail showing the cut bent end of the spiral wire 38 after the cutting process. The cutters 23 and 24 are similar in operation to those commonly used for cutting and bending wire spirals.

The setup of the machine includes the following steps for customizing the subassemblies to match the particular book 12 size and spiral wire 38. The properly sized mandrel 70 is fitted and adjusted laterally by vernier screw 82 to guide spiral 38 to engage the book 12 perforations 39. The proper spinner speed is selected via control 31. The optical sensor is precisely positioned at the left edge of book 12. This may include one or more test runs.

The operation of the machine in the preferred embodiment is as follows:

Book 12 is placed in previously adjusted holder 17;

Right pedal 7 is pressed once to close clamp 13;

Spiral 38 is loaded in chute 8 and its end is positioned around mandrel 70;

Right pedal 7 is pressed one more time to initiate the automatic sequence. After spiral machine stops its sequence, left pedal 6 is pressed once to open clamp 13; and, Bound book 12 with spiral wire 38 therein is removed.

Although many design variations are possible without deviating from the spirit of the invention, the preferred embodiment is electropneumatic in design with no custom electronics or computer control. In this manner, it can be easily maintained by an electromechanical technician with no electronic or computer training. The preferred embodiment uses AC solenoid valves and relays. In alternate embodiments, low voltage DC solenoid valves, solid-state relays and/or microprocessor controls could be used to perform equivalent control tasks.

Figure 7:
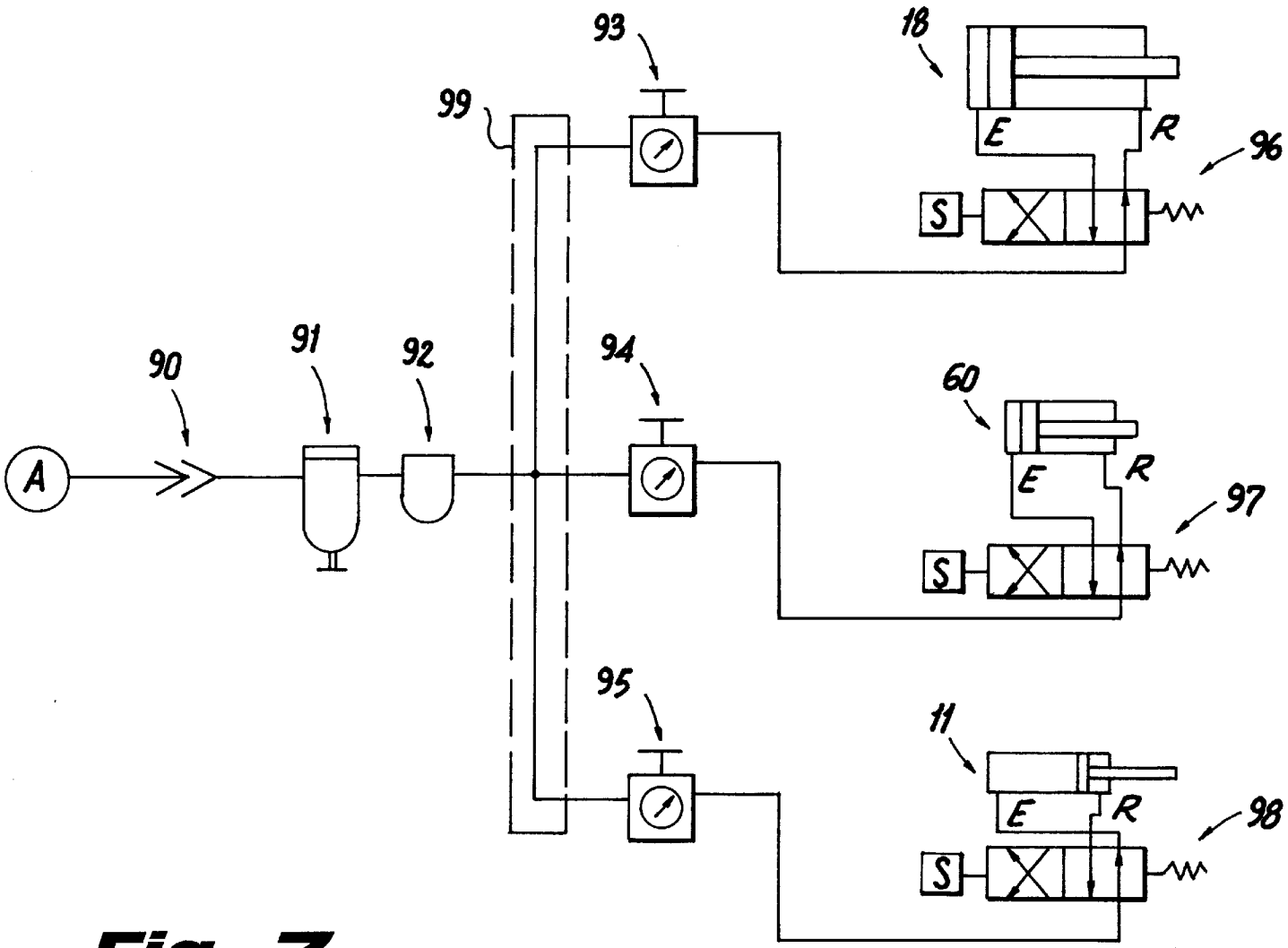
FIG. 7 is a pneumatic schematic diagram.

FIG. 7 shows a pneumatic system schematic. Shop air at 70 to 100 psig is supplied by a hose at A and coupled to the machine via "quick disconnect" 90. A filter/dryer 91 filters contaminants from the compressed air supply and removes moisture.

Next a lubricator 92 adds a small amount of oil to extend the life of the cylinders and valves. A manifold 99 distributes the filtered and lubricated air to three individual pressure regulators with integral indicators 93, 94 and 95. In this manner the pressure to the individual cylinders can be adjusted to select the optimum force for the particular task. Regulator 93 feeds solenoid valve 96 which controls cutter cylinder 18. Similarly, regulator 94 feeds solenoid valve 97 which controls spinner engagement cylinder 60. Finally, regulator 95 feeds solenoid valve 98 which controls the gate actuator cylinder 11. All solenoid valves are of the two port reversing two position type which extend or retract the two port double acting cylinders. The unenergized position of solenoid valves 96 and 97 keep their respective cylinders retracted by supplying pressure to the retract port while venting the extend port. Solenoid valve 98 keeps cylinder 11 extended in its unenergized position to keep the gate open by supplying pressure to the extend port while venting the retract port.

Figure 8:
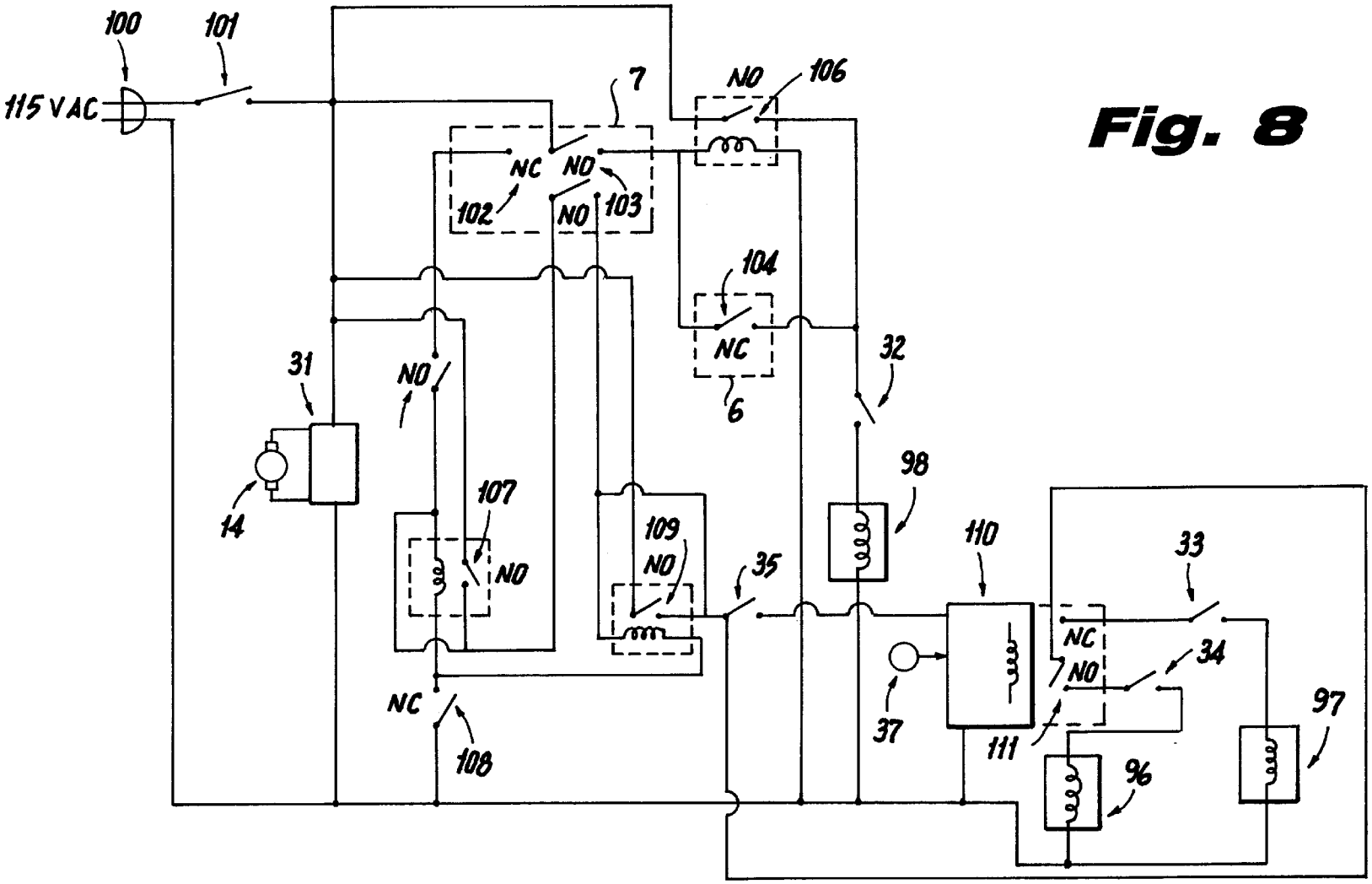
FIG. 8 is one embodiment for an electrical schematic diagram.

FIG. 8 is an electrical schematic of one embodiment. Right pedal 7 has two switches, a single-pole double-throw switch 102 and a single-pole single-throw (SPST) switch 103. The left pedal 6 has an SPST switch 104. Plug 100 supplies 115 VAC through main switch 101. Motor controller 31 drives spinner motor 14 continuously as long as 101 is on. By pressing the right pedal 7 once, relay 106 is energized closing its normally open contacts; it is latched on via feedback through normally closed switch 104. Switches 32, 33, 34 & 35 are simply enable/disable switches used in maintenance as described before. Solenoid valve 98 is energized retracting cylinder 11 and closing the clamp 13. Normally open switch 105, which senses that clamp 13 is closed, is now closed. This latches sequence relay 107 on. When right pedal 7 is again briefly energized, an automatic sequence is started. Switch 103 now energizes relay 109 through relay 107. This powers the sensor controller 110 which has a latched relay at its output 111. The normally closed (NC) contacts of 111 energize solenoid valve 97, which solenoid valve 97 drives spiral wire 38 through book perforations 39. When sensor 37 detects the end of the spiral wire 38 emerging from the left end of book 12, switch 111 is switched to open the NC contacts stopping spiral feeding and closes the normally open contacts which energize solenoid valve 96 thereby operating the cutter mechanism through cylinder 18. When the cutters have completed their cycle, normally closed sensor switch 108 is opened thereby resetting relays 107 and 109 completing the automatic cycle and resetting the appropriate pneumatic cylinders as well as sensor controller 110. Now, when left pedal 6 is briefly pressed, relay 106 is reset by opening switch 104 thereby de-energizing solenoid valve 98 which extends cylinder 11 thereby opening clamp 13 so that bound book 12 can be removed from the machine 1.

Figure 9:
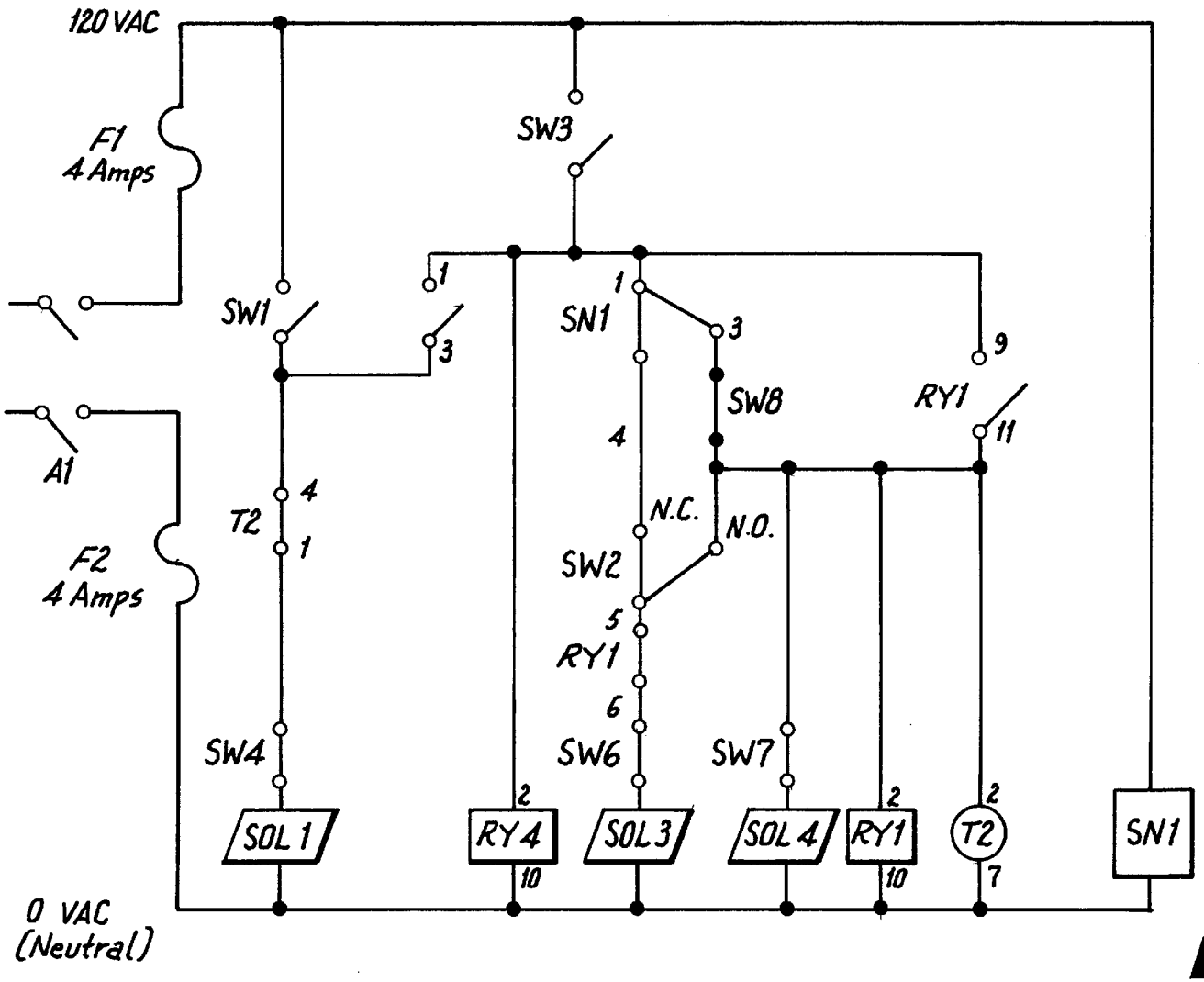
FIG. 9 is the preferred electrical schematic diagram.

FIG. 9 is an electrical schematic for the preferred embodiment. To start the machine 1, one turns on master power switch A1 at circuit line 1. 110 volts AC is supplied to the machine 1 from master power switch A1, and fuse F1 at circuit line 2. If the speed control for the spinner is turned clockwise, the spinner begins to turn.

To make a book, one first inserts a book onto the bottom supports of the clamp 13, shown in FIG. 1. One presses and holds the clamp foot pedal switch SW1 at circuit line 3, thereby activating and closing clamp 13. Through normally open contact of clamp foot pedal switch SW1, normally closed contact of relay RY2, and normally open contact of disable switch SW4, power is provided to clamp solenoid SOL1 at circuit line 3.

Thereafter, the clamp 13 closes. The closing of clamp 13 triggers microswitch SW3 at circuit line 6. Through normally open contact of microswitch SW3, clamp hold relay RY4 is powered at circuit line 5. Normally open contact of clamp hold relay RY4 1–3 closes at circuit line 4. Through microswitch SW3, normally open contact of clamp hold relay RY4, normally closed contact of knife cutter duration timer T2, and normally open contact of disable switch SW4, power is provided to clamp solenoid SOL1. The clamp 13 is then held closed.

Through normally open contact of microswitch SW3, normally closed contact of wire sensor SN1 at circuit line 7, and the normally closed contact of knife cutter foot pedal switch SW2, power is provided to spinner solenoid SOL3. The spinner closes on the spiral wire and begins to feed the spiral wire.

For automatic operation, the spiral wire reaches wire sensor SN1. Normally closed contacts of wire sensor SN1, at circuit line 7, shift to circuit line 8, providing power through microswitch SW3, wire sensor SN1, disable switch SW8, and normally open contact of disable switch SW7 at circuit line 9 to knife solenoid SOL4. The knives cutters 23, 24 come down. In addition, power is provided to knife cutter hold relay RY1 at circuit line 10 and knife cutter duration timer T2 at circuit line 11. Through normally open contact gate closed microswitch SW3 at circuit line 6, and normally opened contact of knife cutter hold relay RY1 at circuit line 11, knife hold relay RY1 and knife duration timer T2 are held on.

For manual operation, the knife cutter foot pedal switch SW2 is pressed. Normally closed contacts of knife cutter foot pedal switch SW2, at circuit line 7 shift to normally open at circuit line 8, providing power through microswitch SW3, wire sensor SN1, knife cutter foot pedal switch SW2, and normally open contact of disable switch SW7 at circuit line 9, to knife cutter solenoid SOL4. The knife cutters 23, 24 then come down. In addition, power is provided to knife cutter hold relay RY1 at circuit line 10 and knife cutter duration timer T2 at circuit line 11. Through normally open contact microswitch SW3 at circuit line 6, and normally open contact of knife cutter hold relay RY1 at circuit line 11, knife cutter hold relay RY1 and knife cutter duration timer T2 are held on.

After the delay time set at knife cutter duration timer T2, the timer T2 operates. The opening of the normally closed contact of knife cutter duration timer T2 at circuit line 3 removes power from clamp solenoid SOL1. The fingers retract and clamp 13 opens. Microswitch SW3 is released. Spiral machine 1 is now ready for the next book.

It is also known that other modifications may be made to the present invention, without departing from the score of the invention, as noted in the appended claims.

We claim:

1. A binding machine for spirally binding a sheaf of papers into a book comprising:

a. means for clamping together the sheaf of papers making up said book, said book having a plurality of holes in a row adjacent one edge of said book to receive the leading edge of said spiral bonding element;

b. a stationary base spaced from one end of said book;

c. a block slidably mounted on said base having an arm extending outwardly and supporting at its distal and thereof a cylindrically shaped mandrel spaced from said slidable block and the bottom edge of said mandrel horizontally in a line with said row of holes in said book, said arm being attached at its distal end to said mandrel at the proximate end of said mandrel facing said row of holes and spaced from said book and said arm attached to said block at the proximate end with means for adjusting the distance between said mandrel and said block;

d. means for feeding onto said mandrel from the distal end thereof a plastic pre-formed, spiral binding element terminating at the proximate end of said mandrel with the leading edge of said binding element facing and spaced from said book, the internal diameter of said spiral binding element being slightly in excess of the outer diameter of said mandrel;

e. spring means mounted on said slidable block for engaging and biasing adjustably said spiral binding element on said mandrel upwardly against said mandrel so that the upper portion of said binding element is spaced from the top of said mandrel;

f. means comprising a wheel having an outer frictional surface for engaging a top outer surface of said spiral binding element and motor means for driving said wheel to feed said spiral binding element into said row of holes in said book for binding same; and g. means for adjusting the position of said block on said base for positioning said mandrel to obtain proper alignment of the leading edge of said spiral binding element with said row of holes.

2. The binding machine of claim 1 having means for cutting said spiral binding element wound on said book at both ends of said book and bending both ends of said binding element on said book.

3. The binding machine of claim 2 having optical sensing means for signaling that the leading edge of said spiral has been reached.

4. The binding machine of claim 3 having pneumatically driven means for positioning said wheel for contact with said spiral binding element including hydraulic shock absorbing means for mediating the speed of engagement of said wheel with said spiral binding element.

5. The binding machine of claim 4 in which said cutting means comprises a pair of spaced cutting members, a rotatable arm for engaging said cutting members and actuating the cutting and bending action when rotated in one direction, means biasing said rotatable arm in the second direction, and means for pneumatically causing the rotation of said rotatable arm in the first direction overcoming said biasing means to cut and bend in unison.

6. The binding machine of claim 5 having a control panel for sequencing the steps of binding said book and indicating visually when said cutting and bending of ends is completed so that the binding action can be repeated for the next book.

* * * * *